US006164957A

United States Patent [19]

Waters et al.

[11] Patent Number: 6,164,957

[45] Date of Patent: Dec. 26, 2000

[54] TRANSDUCER FOR GAS FLARE PILOT FLAME DETECTION

[75] Inventors: William G. Waters, Gloucester; Jeffrey A. Zimmer, Arlington, both of Mass.

[73] Assignee: GTE Internetworking Incorporated, Cambridge, Mass.

[21] Appl. No.: 09/387,664

[22] Filed: Aug. 31, 1999

[51] Int. Cl.[7] ..... F23N 5/16

[52] U.S. Cl. ..... 431/13; 431/74; 431/202; 431/346; 340/577

[58] Field of Search ..... 431/13, 18, 74, 431/75, 202, 346; 73/590; 340/577, 578; 367/182; 381/355, 369, 360, 170

[56] References Cited

U.S. PATENT DOCUMENTS

| | | | |
|---|---|---|---|
| 297,168 | 4/1884 | Rogers | 381/369 |
| 1,581,334 | 4/1926 | Crandall | 381/355 |
| 2,767,783 | 10/1956 | Rowell et al. | 431/75 |
| 2,966,209 | 12/1960 | Pegrum | 431/75 |
| 3,412,376 | 11/1968 | Johnson III | 367/182 |
| 3,811,816 | 5/1974 | Whitman | 431/75 |
| 5,813,849 | 9/1998 | Schwartz et al. | 431/18 |

*Primary Examiner*—Ira S. Lazarus
*Assistant Examiner*—Sara Clarke
*Attorney, Agent, or Firm*—Leonard Charles Suchyta; Floyd E. Anderson; James K. Weixel

[57] ABSTRACT

A pilot flame sensing system employs an electromagnetic transducer (41) at the bottom of a vertical stack (11) used for burning waste gases which incorporates a pilot burner (15) at the top of the stack (11). The electromagnetic transducer (41) responds to acoustic energy generated by the pilot burner (15) and communicates down thorough an igniter tube (21) extending essentially the full height of the stack. At least one diaphragm (43) having a low loss tangent and high modulus is used to suspend the electromagnetic transducer (41) so as to allow the electromagnetic transducer (41) to resonate the diaphragm (43) thus improving a signal to noise ratio of an output signal of the electromagnetic transducer (41). The electromagnetic transducer (41) is preferably of the moving coil geophone type which provides an electrical signal at low impedance which can be coupled through relatively long leads to a remote control facility.

11 Claims, 5 Drawing Sheets

TRANSDUCER FOR GAS FLARE PILOT FLAME DETECTION

FIELD OF THE INVENTION

The present invention related to an acoustic sensing system and more particularly to a sensing system for detecting the existence or absence of a pilot flame.

BACKGROUND OF THE INVENTION

A pilot flame is typically used in gas or other fuel systems as a source to ignite the system when a fuel supply is provided in proximity to the pilot flame. Well known pilot flame uses in domestic applications include gas stoves, water heaters, fireplaces and other home heating systems. In the event that a pilot flame is extinguished, the homeowner simply re-ignites the pilot flame. In commercial applications, a pilot flame failure can be much more problematic than the inconveniences occurring in domestic situations. For example, in refineries and oil fields, it is frequently necessary to burn off substantial quantities of waste and perhaps toxic hydrocarbon gases. Typically, a relatively tall stack is employed which will be located outdoors and a substantial distance from any control facility. While various schemes have been proposed for igniting a burnoff flare, starting with bows and flaming arrows, most modern facilities use a pilot burner which maintains a flame adjacent the top of the stack. However, even the most carefully designed pilot burner can be extinguished and it is increasingly undesirable to release waste gas when no immediate source of ignition is present.

Various systems have been proposed for monitoring the presence of a pilot flame. Optical systems have been used to detect the pilot flame from the ground but suffer from false readings due to fog interference or detector mistakes due to direct sunlight. Thermocouples are also available but typically have a short useful life due to the heat in the stack. In addition, maintenance and replacement of the electronics or sensing mechanism can be difficult.

Re-lighting of a pilot burner is typically implemented by means of an igniter tube which extends essentially the full height of the stack. To re-start the pilot burner, this igniter tube is filled with a gas/air mixture which is then electrically ignited at the bottom of the stack. A flame front progresses up the igniter tube until it reaches the top of the stack where it can ignite the pilot burner itself. Such systems are known in the art and are not described in detail hereinafter.

It has been found that the burners used for maintaining the pilot flame emit a characteristic acoustic signature with much of the acoustic energy being contained in a relatively narrow, low frequency band, e.g., 250 Hz to 500 Hz. This frequency band will vary, however, according to the application and magnitude of the pilot flame. Further, if an appropriate microphone or sensor system is available, the acoustic signature of the burner can, to some extent, be tuned to match or cooperate with the characteristics of the microphone or sensor. Sensing can be still further complicated by the fact that the sensing mechanism is often outdoors and thus exposed to undesirable environmental conditions. Therefore, the microphone or sensor may be required to operate in a relatively hostile environment.

Thus, what is needed is a capability to detect a pilot flame according to the acoustic characteristics of the pilot flame with a high degree of accuracy while being located in a location away from the pilot flame and easily accessed for service. The pilot flame detection must be highly reliable even in a hostile environment.

SUMMARY OF THE INVENTION

A first object of the present invention is to provide an improved pilot flame detector system.

Another object of the present invention is to provide a pilot flame detector tuned to a characteristic frequency or frequency band of the pilot flame acoustic signature.

Still another object of the present invention is to provide a pilot flame detector that does not require any electronics or transducers proximate to the pilot flame, and that can be operated in a hostile environment and at a substantial distance from any control facility.

In a first embodiment of the present invention, a sensing system detects whether a pilot flame is lit by responding to an acoustic energy emitted by the pilot flame. An igniter tube provides a gas/air mixture for the pilot flame and the acoustic energy of the pilot flame is coupled to the sensing system by a coupler having a port for communicating the emitted acoustic energy. A chamber is provided for communicating with the coupler through the port, wherein the chamber houses an electromagnetic transducer mounted on a diaphragm spanning the chamber wherein the electromagnetic transducer responds to the emitted acoustic energy entering the chamber from the tube. The electromagnetic transducer provides an electric signal corresponding to acoustic energy coupled from the pilot flame through the port. The diaphragm resonates in combination with the electromagnetic transducer thereby improving the signal to noise ratio associated with an output signal of the electromagnetic transducer.

In another embodiment of the present invention, a sensing system is adapted to operate in the context of an essentially vertical stack for burning unwanted hydrocarbon gases which incorporates a pilot burner at the top of the stack and an igniter tube extending essentially the full height of the stack. A port opens into the igniter tube extending essentially the full height of the stack. A port opens into the igniter tube at the lower end thereof and structure defining a chamber communicating with the tube through the port is provided. A flame arrester in the port blocks flame fronts from entering the chamber itself. A moving coil, electromagnetic transducer is mounted in the chamber and a diaphragm spanning the chamber couples, to the transducer, acoustic energy entering the chamber from the igniter tube. Accordingly, the transducer provides an electric signal corresponding to acoustic energy coupled from the pilot burner through the igniter tube. Preferably, the electromagnetic transducer is of the moving coil type so that the signal is provided at a low source impedance which can be coupled through relatively long leads to a remote control facility.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
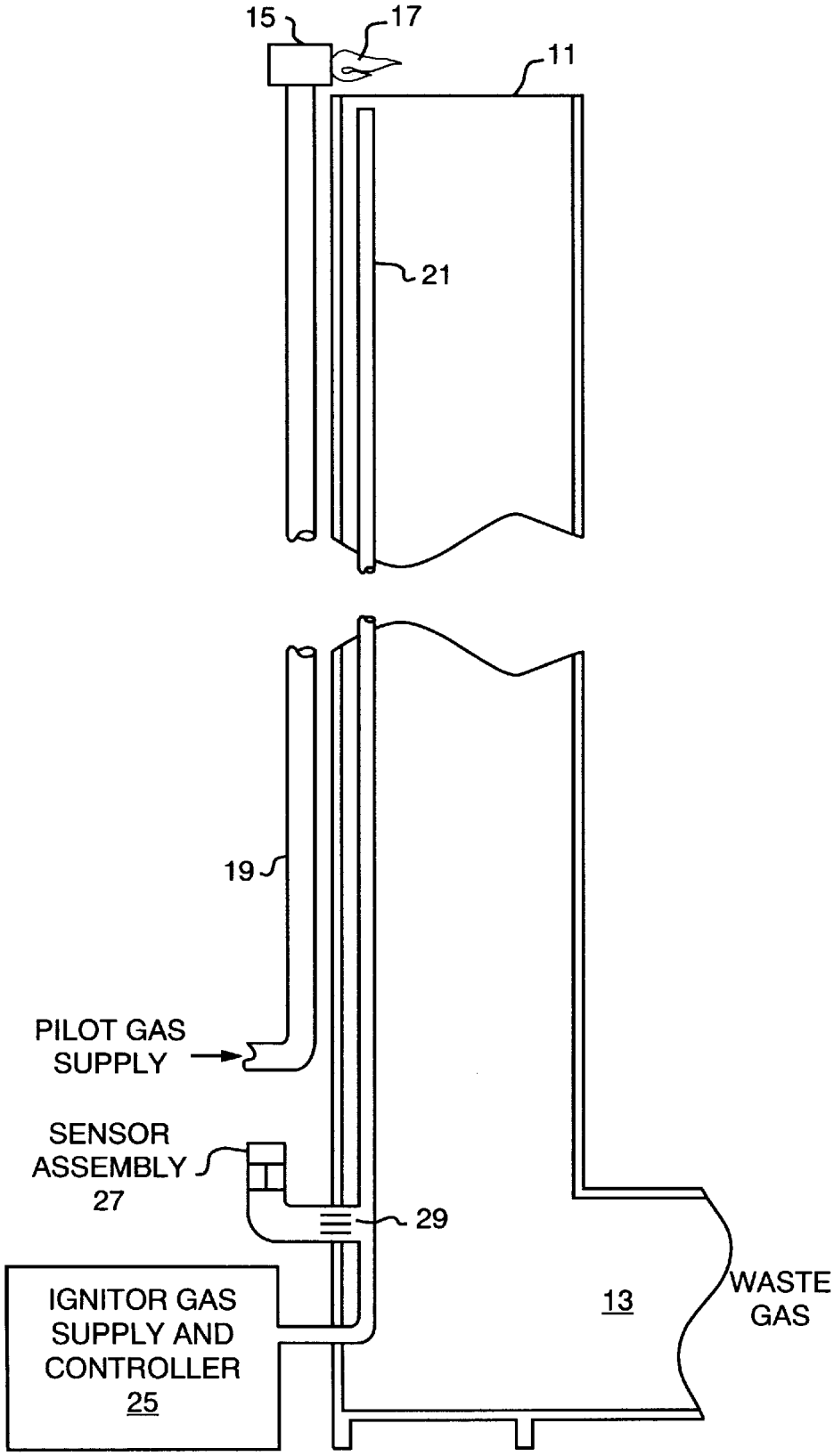
FIG. 1 is a schematic diagram illustrating a gas burnoff stack incorporating a pilot burner and a sensing system in accordance with the present invention.

Referring now to FIG. 1, a pilot burner 15 for maintaining a pilot flame 17 is situated at a top end of a stack or tube 11. The pilot flame 17 is separated in terms of a vertical distance from a sensor assembly 27 by the tube or stack. Preferably, the sensor assembly 27 is located in a location convenient for access and hence servicing, wherein the sensor assembly 27 detects the presence or absence of the pilot flame 17. Gas to feed the pilot burner 15 is provided through a feed tube 19. In one particular embodiment of the present invention, the tube or stack 11 is a vertical stack for burning unwanted hydrocarbon waste gases, waste gases being provided thereto at the bottom through a port 13.

Parallel to and preferably outside of stack 11 is an igniter tube 21 which extends essentially the full height of the stack 11. When it is desired to re-light the pilot flame 17, the igniter tube 21 is filled with an air/gas mixture and is ignited by a gas supply and controller system designated generally by reference character 25. Such systems are known in the art and are not described in detail herein. The sensor assembly 27 communicates with the interior of the igniter tube 21 through a lateral port 29 in the side of the igniter tube 21, wherein the igniter tube 21 doubles as an acoustic waveguide.

Figure 2:
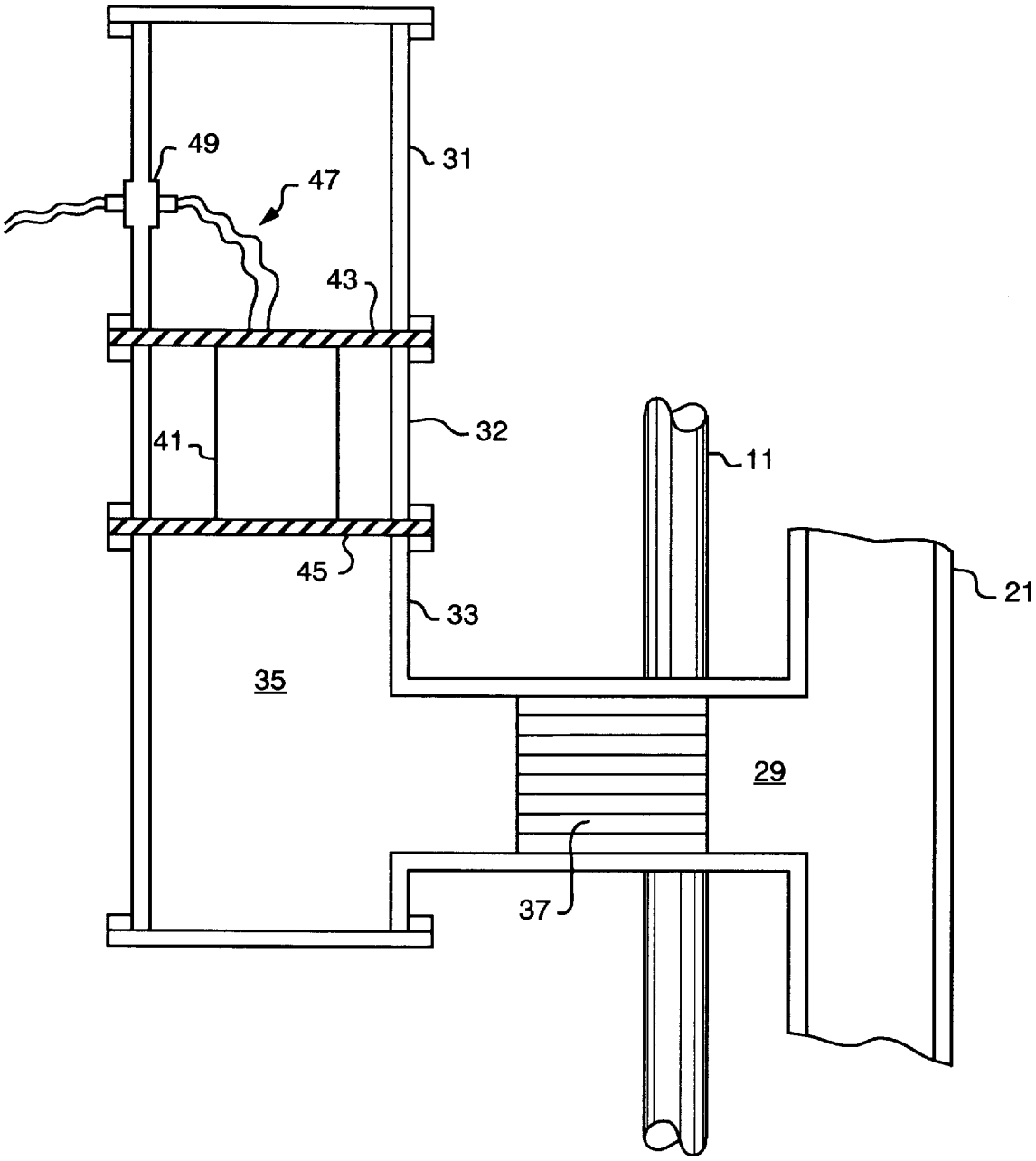
FIG. 2 is a diagram illustrating mechanical arrangement of the components of the sensing system coupled to the burnoff stack.

Referring now to FIG. 2 where the sensor assembly 27 is illustrated in greater detail, it may be seen that a housing structure assembled from several sections 31–33 provides a cylindrical chamber 35 communicating with the igniter tube 21 through a port 29. If necessary, a flame arrester 37 is mounted in the port 29 to block flame fronts from entering the chamber 35. As is understood by those skilled in the art, a flame arrester may be implemented by a series of parallel metal plates which can pass an air flow or acoustic energy but which possess sufficient thermal inertia to block a flame front.

An electromagnetic transducer 41 is mounted in the chamber 35 by means of a pair of diaphragms 43 and 45 spanning the cylindrical chamber. As is described in greater detail hereinafter, transducer 41 is preferably a moving coil transducer providing a relatively low source impedance suitable for driving relatively long signal leads. In the preferred embodiment, the moving coil electromagnetic transducer 41 is a geophone which provides a relatively rugged, commercially available, mechanical construction. Leads 47 from the geophone are coupled through the wall of the chamber by means of feedthrough assemblies 49. Silicone rubber is one suitable embodiment for the diaphragms 43 and 45 since it is a low glass-transition elastomer whose modulus is relatively independent of temperature. This is desirable because of the very wide range of ambient temperatures which may be encountered out of doors where the stack and the sensor assembly 41 may be located.

Figure 3A:
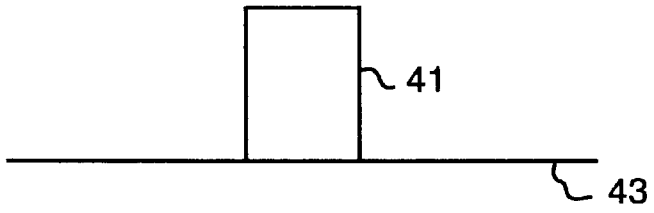
FIGS. 3A–3C are diagrams illustrating alternate arrangements for suspending an electromagnetic transducer on one or more diaphragms.
Figure 3B:
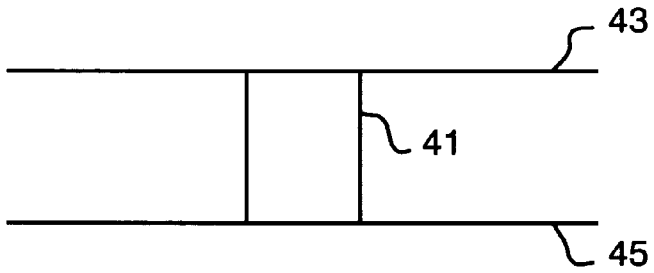
Figure 3C:
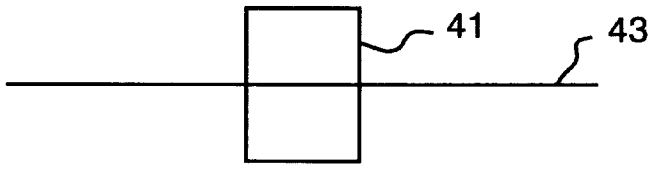

FIGS. 3A through 3C depict a preferred embodiment of the present invention wherein the diaphragms 43 and 45 are realized from a thin metal material, for example, stainless steel, copper, berilyum or other suitable material possessing a low loss tangent and high modulus thus having the ability to resonate with the geophone 41 while providing suitable support. In FIG. 3A, the geophone 41 is mounted upon a single diaphragm 43. In FIG. 3B the geophone 41 is mounted between two diaphragms 43 and 45. Finally, in FIG. 3C, the geophone 41 is mounted within the diaphragm 43. In each instance of the embodiments shown in FIGS. 3A–3C, the diaphragms 43 and 45 have a thickness suitable to resonate with the mass of the geophone 41 in response to the acoustic energy of the pilot flame 17.

In a preferred embodiment of the present invention, the diaphragm 43 was constructed of stainless steel having a thickness on the order of ten to fifteen mils. The geophone 41 typically generates an output signal of less than ten millivolts. The signal to noise ratio of the flame noise to extraneous noise sources is an important consideration when detecting the pilot flame by its acoustic signature. The signal to noise ratio is desired to be as large as possible, but typically at least ten db is necessary for reliable performance. In the instant invention, the geophone 41 will resonate in combination with the diaphragm 43 so as to add positively to the output signal thereby improving a signal to noise ratio therein, for example, by approximately forty db. The particular thickness selected for the diaphragms 43 and 45 will depend upon such factors as the weight of the geophone 41 and the acoustic energy and characteristic frequency of the pilot flame 17.

Figure 4:
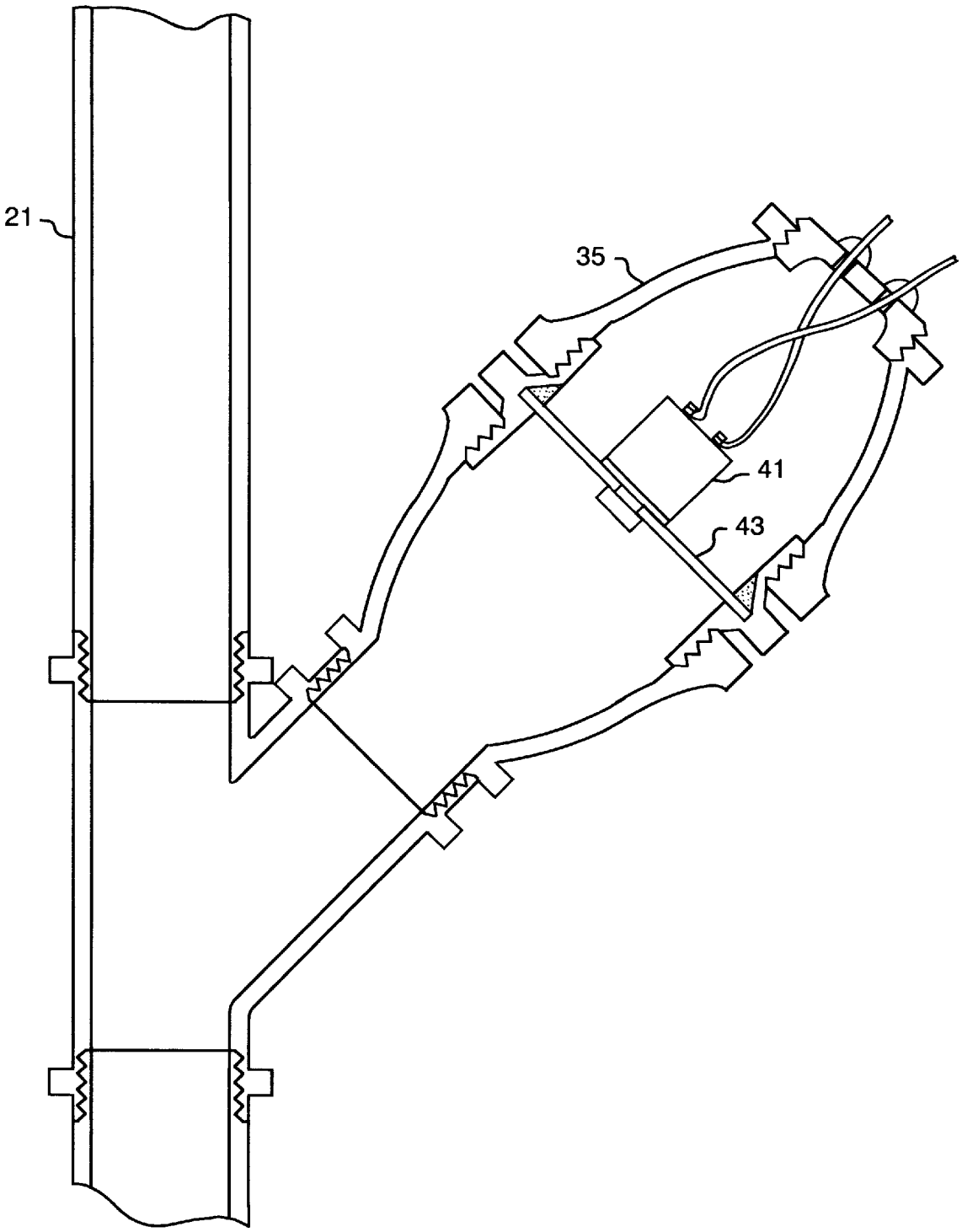
FIG. 4 is a diagram of a chamber for housing the diaphragms and electromagnetic transducer in relation to an igniter tube.

FIG. 4 shows an alternate embodiment of the chamber 35 wherein the geophone 41 and the diaphragm 43 are suspended within the chamber 35 and the chamber 35 is angled, for example, on a forty-five degree angle relative to the igniter tube 21. Angling the diaphragm 43 allows for any moisture collection or buildup to be caused to drain away from the diaphragm 43 that would otherwise adversely affect the accuracy of pilot flame detection. Furthermore, the igniter tube 21 need not be vertical but could be horizontal or otherwise angled so long as the diaphragm 43 is angled in relation thereto so as to not collect moisture if environmental conditions are a concern. The enclosed volume on the output side of the diaphragm (chamber 35 in FIG. 4) must not be too small. For example, the minimum volume was found to be about seven cubic inches for a 2.7 inch diameter diaphragm resonating at about 400 Hz. The chamber may be sealed so as not to introduce acoustic losses.

Figure 5:
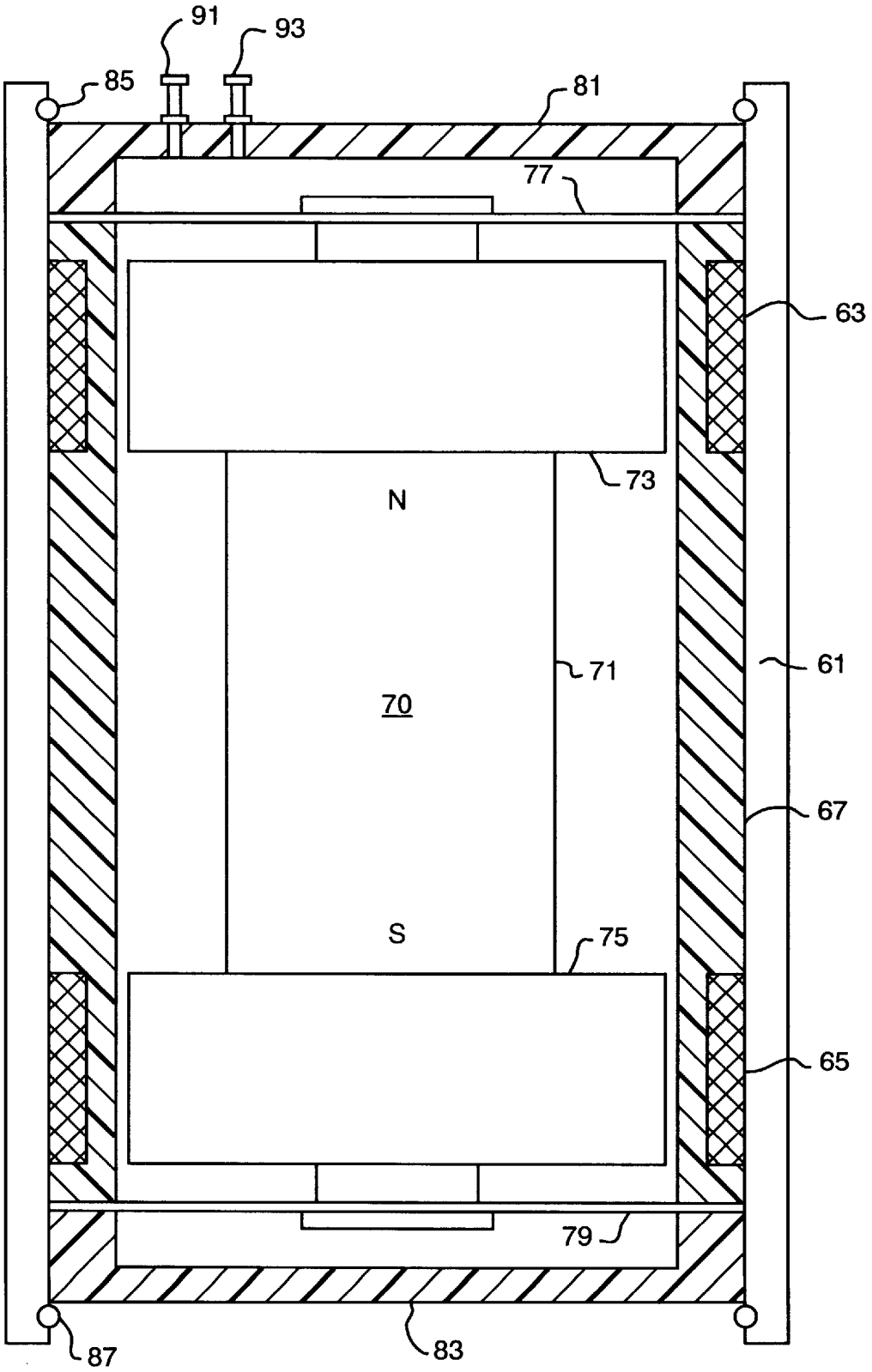
FIG. 5 is a diagram substantially in cross-section, illustrating a moving coil electromagnetic transducer employed in the sensing system of FIGS. 1 through 5.

A suitable moving-coil geophone construction is illustrated in simplified form in FIG. 5. A magnetically permeable but relatively lightweight cylindrical shell is designated by reference character 61. A pair of coils 63 and 65 are wound on a lightweight plastic bobbin 67 which fits closely within shell 61. A polarizing magnet structure 70, which also constitutes an inertial mass, is made up of a permanent magnet 71 together with a pair of disk-like pole pieces 73 and 75. The pole pieces 73 and 75 are positioned nominally in alignment with the coils 63 and 65 respectively, as illustrated. This inertial mass is resiliently suspended within the bobbin 61 by a pair of disk-like springs 77 and 79 which are spirally slit in known manner to increase axial compliance. Springs 77 and 79 are retained within the shell 61 by plastic endcaps 81 and 83 which are, in turn, retained by ring clips 85 and 87. Leads (not shown) connect the coils 63 and 65 to terminals 91 and 93 on the endcap 81.

As is understood by those skilled in the art, the transducer construction of FIG. 5 can respond to vibration and/or other acoustic energy when the shell 61, together with the coils 63 and 65, is vibrated, e.g. by a structure to which they are attached. The coils 63 and 65 move relative to the inertial mass of the magnetic structure 70 which remains relatively stationary (within the bandwidth of interest) due to the compliance of the springs 77 and 79.

In the practice of the present invention, acoustic energy received from the pilot burner 15 through the igniter tube 21 operates on the diaphragms 43, 45 so as to impart vibrational energy to the shell of the geophone assembly 70, in turn generating a corresponding electrical signal in the coils 63 and 65. Since the moving coil arrangement of this type of electromagnetic transducer provides a very low source impedance, it is not necessary to have amplifiers or other electronics in close proximity to the sensor assembly 27. Rather, signals can be communicated directly through relatively long leads to a remote control center. Accordingly, it can be seen that a relatively simple and reliable acoustic sensor is implemented which can survive relatively harsh conditions and can provide a reliable indication of pilot burner operation by providing a signal corresponding to the acoustic signature of the pilot burner.

As will be appreciated, the process of igniting the pilot burner will produce, in the transducer, a relatively strong signal and detection of this signal can provide a confirmation that the transducer is in fact operating so that, if the pilot burner is successfully lit, detection of its acoustic signature should be forthcoming. A modification which would provide redundancy and further verification of system operation would be to employ two sensor assemblies separated vertically along the igniter tube 21 by a distance of about five feet. The ignition flame front would then provide two signals, one from each transducer in time relation as the flame front goes from bottom to top through the igniter tube.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A sensing system for detecting whether a pilot flame is lit by responding to an acoustic energy emitted by the pilot flame, wherein an igniter tube provides a gas/air mixture for the pilot flame and the acoustic energy of the pilot flame is coupled to the sensing system by a coupler having a port, said sensing system comprising:

a chamber communicating with said coupler through said port;

an electromagnetic transducer mounted in said chamber;

A diaphragm spanning said chamber for coupling, to said electromagnetic transducer, acoustic energy entering said chamber from said tube;

said electromagnetic transducer providing an electric signal corresponding to acoustic energy coupled from said pilot flame through said port, and said diaphragm resonates in combination with said electromagnetic transducer for improving a signal to noise ratio associated with said electromagnetic transducer.

2. The sensing system according to claim 1 further comprising a flame arrester mounted in said port.

3. The sensing system according to claim 1 wherein said transducer is a moving coil transducer.

4. The sensing system according to claim 1 wherein said transducer is a geophone.

5. The sensing system according to claim 1 wherein said diaphragm is constructed of stainless steel.

6. In an essentially vertical stack for burning unwanted hydrocarbon gases which incorporates a pilot burner at the top of the stack and an igniter tube extending essentially a full height of the stack, a sensing system for responding to acoustic energy emitted by the pilot burner;

a port opening into said igniter tube in the lower portion thereof;

a chamber communicating with said tube through said port;

a flame arrester mounted in said port for blocking flame fronts from entering said chamber;

a moving coil electromagnetic transducer mounted in said chamber;

a diaphragm spanning said chamber for coupling, to said transducer, acoustic entering said chamber from said tube;

said electromagnetic transducer provides an electric signal corresponding to acoustic energy coupled from said pilot flame through said igniter tube, and said diaphragm resonates in combination with said electromagnetic transducer for improving a signal to noise ratio associated with said electromagnetic transducer.

7. The sensing system according to claim 6 wherein said transducer incorporates a tubular outer shell which carries at least one coil and a magnetically energized inertial mass resiliently suspended within said shell for generating an electrical signal in said coil when said shell is vibrated.

8. In a stack for burning unwanted gases which incorporates a pilot burner at the top of the stack and an igniter tube extending essentially the full height of the stack, a sensing system for responding to acoustic energy emitted by the pilot burner;

a port opening laterally into said igniter tube in the lower portion thereof;

means defining a substantially non-vertical cylindrical chamber communicating with said tube through said port;

an electromagnetic transducer incorporating a tubular outer shell which carries first and second vertically spaced coils and an inertial mass resiliently suspended within said shell, said inertial mass including a vertically polarized permanent magnet for generating electrical signals in said coils when said shell is vibrated;

a pair of diaphragms spanning said chamber for supporting said transducer in said chamber and for coupling, to said transducer, acoustic energy entering said chamber from said igniter tube;

said electromagnetic transducer providing an electric signal corresponding to acoustic energy generated by said pilot burner, and said pair of diaphragms resonating in response to said electromagnetic transducer for improving a signal to noise ratio associated with said electromagnetic transducer.

9. The sensing system according to claim 8 wherein said diaphragms are constructed of stainless steel.

10. The sensing system according to claim 8 further comprising a flame arrester mounted in said port for blocking flame fronts from entering said chamber.

11. A method for detecting a presence of an acoustic energy having a characteristic acoustic signature as generated by an acoustic energy source, said acoustic energy monitored by an acoustic energy sensor mounted on a diaphragm, said method comprising steps of:

(a) transmitting said acoustic energy through an acoustic waveguide to said acoustic energy sensor;

(b) resonating said diaphragm in combination with said acoustic energy sensor according to the characteristic acoustic frequency in order to improve a signal to noise ratio of an output of said acoustic energy sensor when said acoustic energy source is emitting said acoustic energy; and (c) providing the output of said acoustic energy sensor to indicate the presence or absence of said acoustic energy.

* * * * *

UNITED STATES PATENT AND TRADEMARK OFFICE

CERTIFICATE OF CORRECTION

PATENT NO. : 6,164,957
DATED : December 26, 2000
INVENTOR(S) : William G. Waters, et al.

It is certified that error appears in the above-identified patent and that said Letters Patent is hereby corrected as shown below:

Title page, item [75]
Inventors, replace "William G. Waters" with -- Bill G. Watters --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*